US005471808A

United States Patent [19]

De Pieri et al.

[11] Patent Number: 5,471,808

[45] Date of Patent: Dec. 5, 1995

[54] BUILDING BLOCK

[76] Inventors: Bruno De Pieri, Casale Sul Sile; Massimo De Pierri, Treviso; Cesare De Pieri, Mogliano Veneto, all of Italy

[21] Appl. No.: 140,387

[22] Filed: Oct. 22, 1993

[30] Foreign Application Priority Data

Nov. 3, 1992 [IT] Italy ..... TV92A0127

[51] Int. Cl.[6] ..... E04C 2/04

[52] U.S. Cl. ..... 52/603; 52/604; 446/128

[58] Field of Search ..... 52/596, 603, 604, 52/605, 601, 309.13, 309.1; 446/108, 110, 111, 120, 127, 128

[56] References Cited

U.S. PATENT DOCUMENTS

| | | | |
|---|---|---|---|
| D. 350,824 | 9/1994 | Perrin, Jr. | D25/113 |
| 3,005,282 | 10/1961 | Christiansen | 446/128 |
| 3,405,479 | 10/1968 | Paulson | 446/128 |
| 3,593,480 | 7/1971 | Bouchillon . | |
| 4,833,856 | 5/1989 | Zwagerman | 446/127 X |
| 4,964,833 | 10/1990 | Suzuki | 446/128 X |
| 4,964,834 | 10/1990 | Myller | 446/128 X |
| 5,078,354 | 1/1992 | Kim | 446/128 X |
| 5,230,195 | 7/1993 | Sease | 52/603 X |

FOREIGN PATENT DOCUMENTS

| | | |
|---|---|---|
| 2711724 | 9/1978 | Germany . |
| 2113741 | 8/1983 | United Kingdom . |

*Primary Examiner*—Carl D. Friedman
*Assistant Examiner*—Kien T. Nguyen
*Attorney, Agent, or Firm*—Guido Modiano; Albert Josif

[57] ABSTRACT

The building block has a hollow body with lateral surfaces which bear a decorative finish, a flat upper surface having studs protruding therefrom, and a bottom opening defining seats for accommodating the upwardly protruding studs of an underlying block. A frog is formed in the flat upper surface for permitting the introduction of an adhesive medium between adjacent blocks. The block can be provided with a framework having an upper frame and legs for interposition between adjacent blocks.

20 Claims, 4 Drawing Sheets

BUILDING BLOCK

BACKGROUND OF THE INVENTION

The present invention relates to a building block particularly usable, by stacking, in the field of interior or external building or in the field of interior decoration.

It is currently known to use, in the construction of buildings, hollow or solid blocks or bricks which are stacked on top of each other and staggered, with layers of mortar interposed to allow rigid mutual bonding of said bricks.

However, this known art has some drawbacks: such bricks in fact are heavy. This increases difficulty in laying and can cause damage if they slip from the bricklayer's grip.

The working space can furthermore be easily soiled by the mortar which falls when the bricks are laid.

In any case, laying such bricks requires specialized personnel.

SUMMARY OF THE INVENTION

An aim of the present invention is therefore to solve the described technical problems by eliminating the drawbacks described in known types and thus providing a building block, according to the present invention, which allows the easy and rapid construction of load-bearing walls or partitions even by personnel which is not specifically trained.

Within the scope of the above aim, an important object is to provide a block which can be handled in conditions of maximum safety both for the user and for the surrounding space.

Another important object is to provide a block the laying whereof keeps the surrounding space clean.

Yet another object is to provide a block which is reliable and safe in use, has modest manufacturing costs and allows to build a wall which is aesthetically finished.

With the foregoing and other objects in view, there is provided a building block particularly usable by stacking in the field of interior or external building or in the field of interior decoration, characterized in that it comprises a hollow body which has modular dimensions and is provided, in an upward region, with one or more means for temporary coupling to engagement means formed underneath said hollow body, at least one hollow blind frog for bonding means being formed above said hollow body. Advantageously, one or more elements for connection to one or more frameworks are present laterally to the hollow body.

Conveniently, furthermore, one or more anchoring brackets are associable above the hollow body.

BRIEF DESCRIPTION OF THE DRAWINGS

Further characteristics and advantages of the building block according to the present invention will become apparent from the following detailed description of a particular but not exclusive embodiment thereof, illustrated only by way of non-limitative example in the accompanying drawings, wherein.

DESCRIPTION OF THE PREFERRED EMBODIMENTS

Figure 1A:
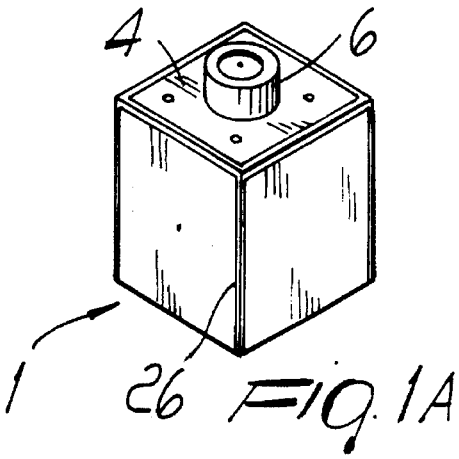
FIG. 1, 1A and 1B are respectively a lateral perspective view of the block according to the present invention and of types related to said block.
Figure 1B:
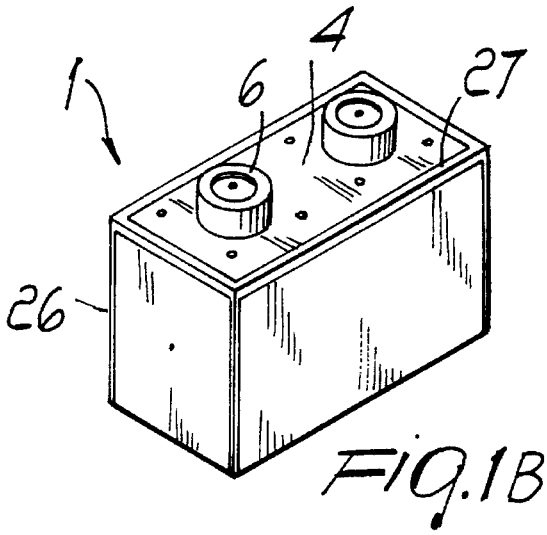
Figure 1:
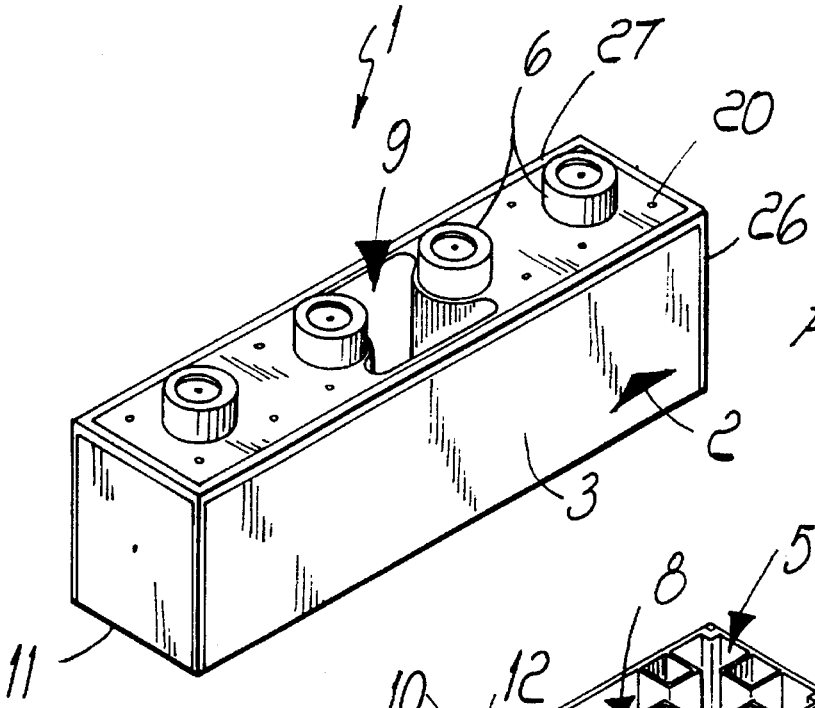
Figure 2:
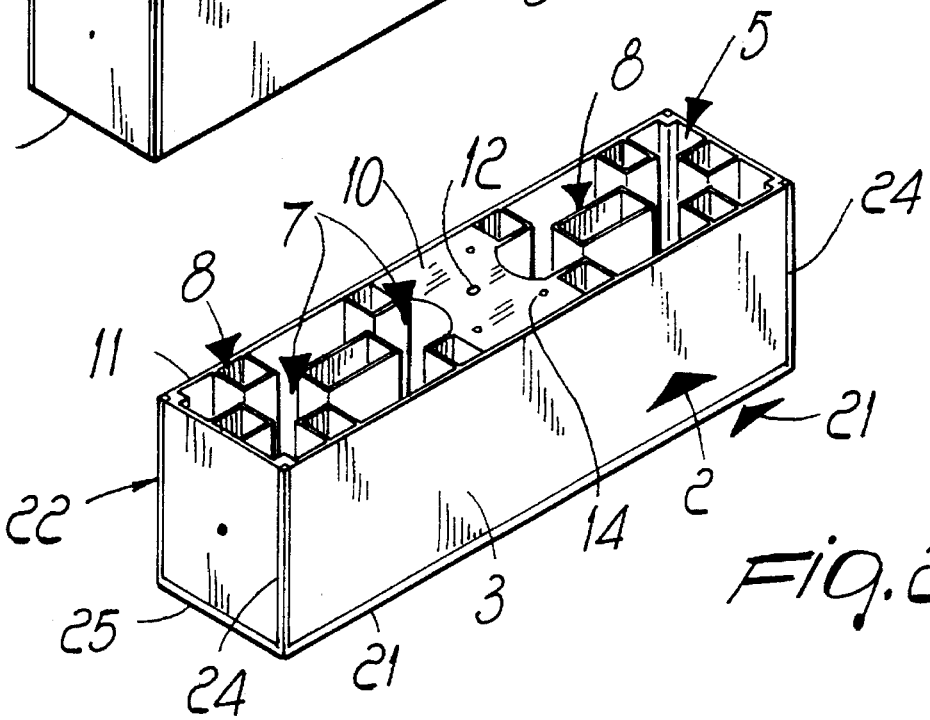
FIG. 2 is a bottom view, similar to the preceding one, of the block.
Figure 3:
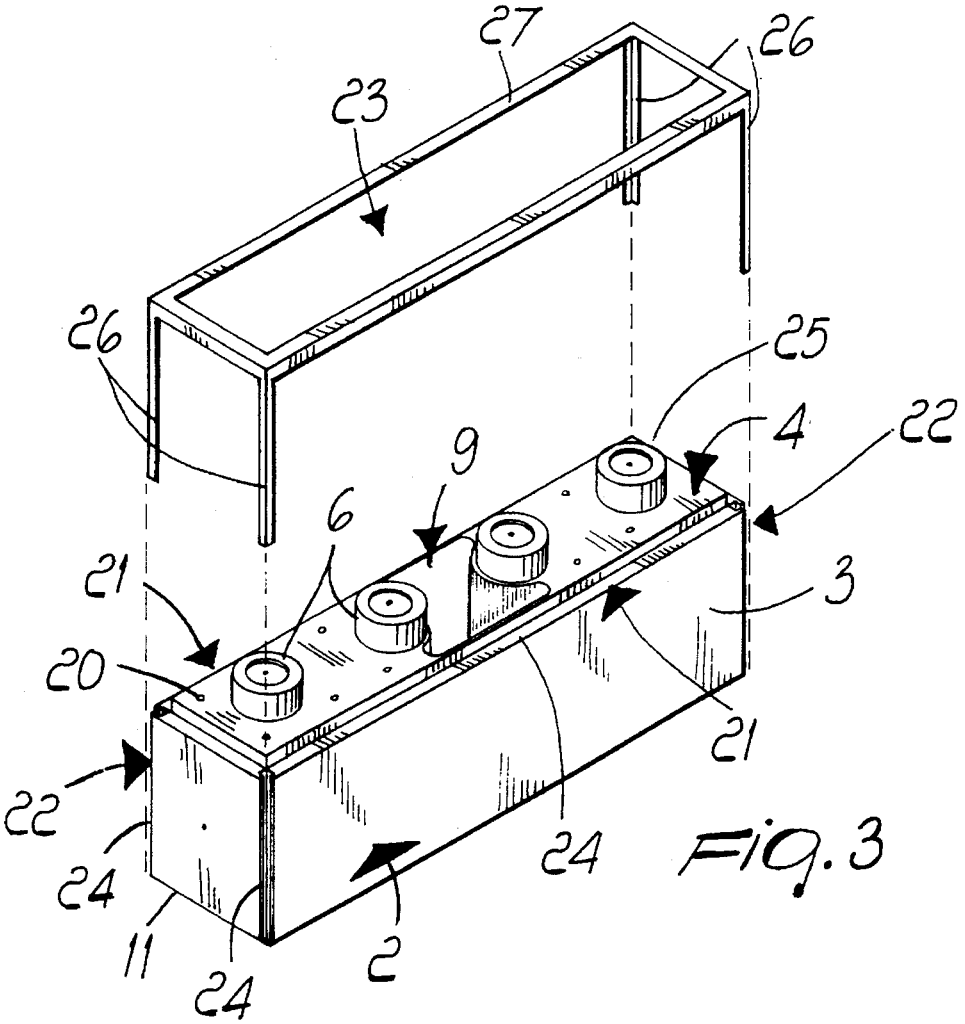
FIG. 3 is a lateral perspective view of the block and of a cage.

With reference to the above figures, the reference numeral 1 designates the block, which is particularly usable, by mutual stacking, in the field of interior or external building, for example for the construction of dividing walls or gazebos, and in the field of interior decoration, for example for building shelves or table legs.

Each of said blocks 1 is constituted by a hollow body 2, which is preferably shaped like a parallelepiped with a square or rectangular base and preferably made of plastics.

At its lateral surfaces 3, each of said hollow bodies 2 can be appropriately colored or bear silk-screen printing.

Furthermore, the dimensions of each block 1 are such as to obtain a modular system, so that for example the length of each hollow body 2 is a multiple of its width.

A flat surface 4 is present in the upper region of said hollow body 2, and an opening 5 is formed in the lower region thereof.

Temporary coupling means, preferably constituted by one or more studs 6 with a circular or polygonal plan shape, furthermore protrude at the flat surface 4.

If multiple studs 6 are used at the same flat surface 4, care is taken to arrange them at a pitch equal to their width.

Said temporary coupling means interact with first engagement means formed beneath the hollow body 2; said engagement means are constituted by first seats 7 for accommodating said studs 6, which are associated in a snap-together manner by virtue of the presence of one or more wings 8 provided laterally with respect to said first seats 7; said wings protrude underneath the flat surface 4, and at least one of them is elastically deformable to allow the placement of the stud within the first seats 7 and lock it in this position.

A recess or frog 9 is furthermore formed at the flat surface 4 and is open at the top and closed downwardly by a bottom element 10 which connects the lower perimetric edges 11 of the lateral surfaces 3.

A first central hole 12, for means for anchoring to the ground such as, for example, a screw anchor 13, is formed at the bottom 10.

One or more second lateral holes 14 are also formed at the bottom 10 and act as seats for further anchoring means as screws or screw anchors suitable for securing the block in a building structure so as to increase rigidity with respect to other mutually stacked blocks.

As an alternative to the use of the screw anchor 13, it is possible to associate an adhesive product or a double-sided adhesive tape underneath the bottom 10 of the frog 9.

The block 1 is also vertically associable with a wall or with an existing structure by using one or more anchoring brackets 15, which are preferably L-shaped and on the wings of which there are provided third holes 16 and fourth holes 17 at which first screws 18 and second screws 19 are placed;

said first screws anchor the bracket to a wall or to an existing structure, and said second screws engage fifth holes 20 formed on the flat surface 4 laterally to the studs 6.

Advantageously, the body 2 defines lateral perimetric edges 22 between upper 21 and lower 11 perimetric edges thereof and one or more elements for connection to a framework 23, such as second and third engagement means comprising second seats 24 and third seats 25 preferably shaped so as to form a dovetail and a step respectively, are advantageously provided on the side of the hollow body 2, at one or more of the upper perimetric edges 21 and at the lateral perimetric edges 22.

Complementarily shaped legs 26 of the framework 23 can be inserted at the second seats 24, whereas the upper frame 27 of the framework 23 can be placed at the third seats 25.

Said framework 23 can have such an aesthetic configuration as to resemble the presence of the mortar gap usually present between two conventional bricks.

Figure 4:
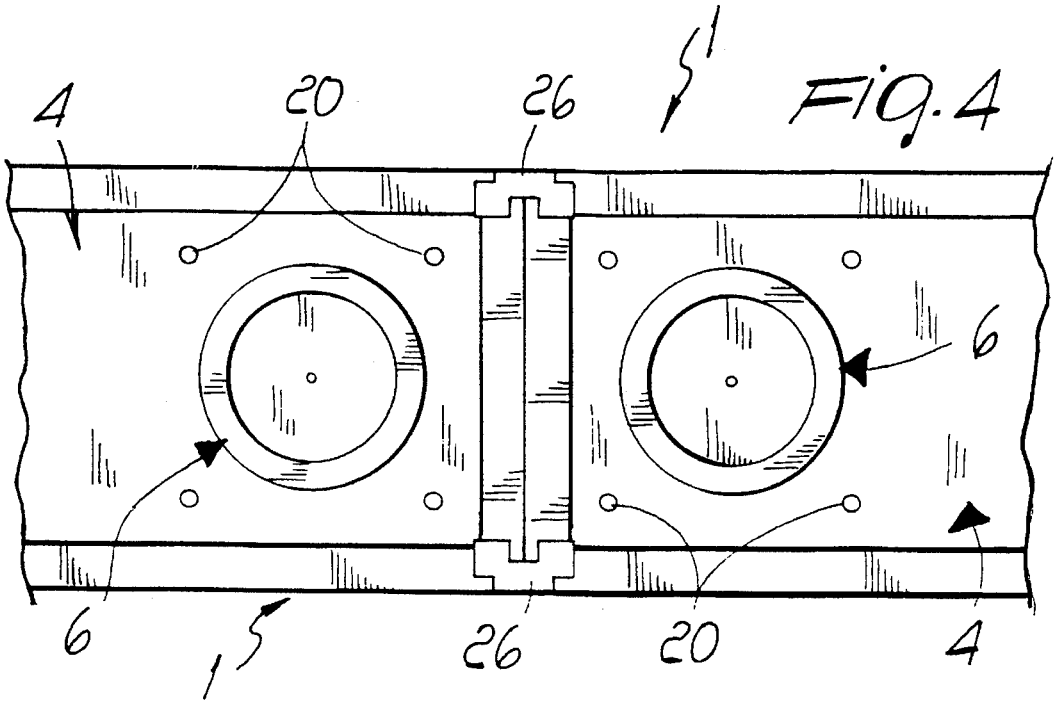
FIG. 4 is a top view of two mutually adjacent blocks.

The shape of the legs 26 and of the framework 23 can furthermore be such as to allow the mutual connection, as shown in FIG. 4, of two mutually adjacent hollow bodies 2, thus constituting a further element for strengthening the block.

The configuration of the second seats 24 may naturally be the most appropriate according to the specific requirements.

If the elements for connection to the frameworks are not provided, the decorative resemblance of mortar can be silk-screen printed directly at the lateral surfaces 3 of each block 1.

Figure 8:
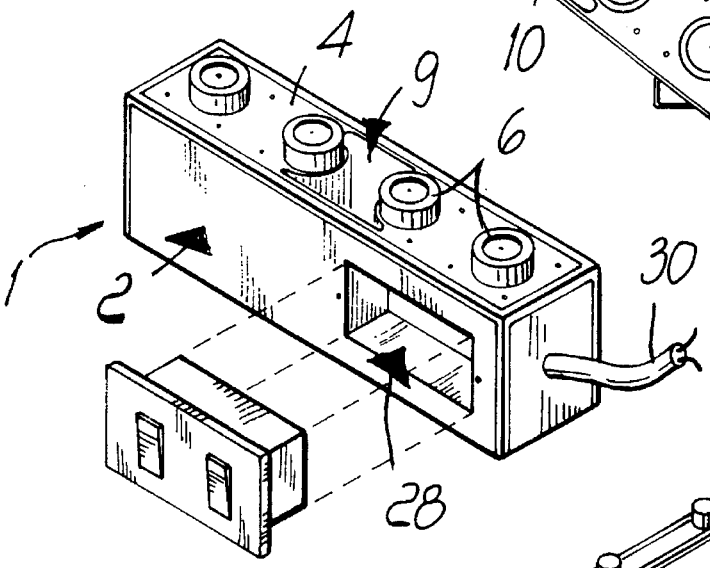
FIG. 8 illustrates a block usable for electric systems.

Furthermore, at the lateral surface 3 it is possible to form a fourth seat 28 for accommodating boxes for the passage of electric systems, as shown in FIG. 8.

The cables constituting said electric systems can be passed inside the hollow body 2; guiding notches 29 for a hole, which can be made for example by means of a drill and is such as to allow the passage of the cables 30, are also advantageously formed at the lateral surfaces 3.

The mutual connection of various blocks allows to form 90° corners or other corners, as shown in FIG. 8.

Figure 10:
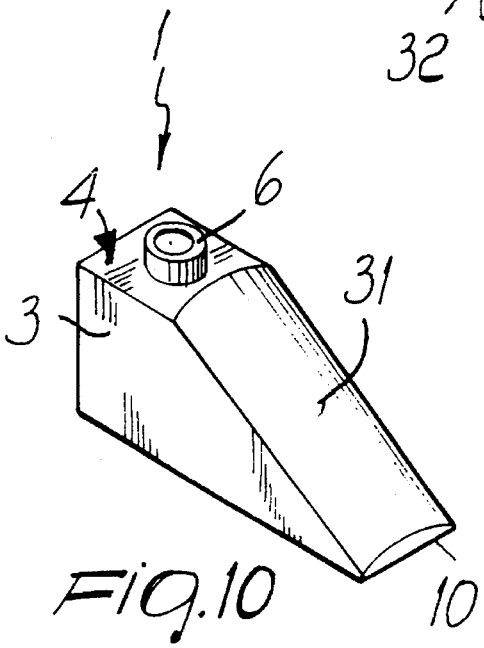

Naturally, the shape of the block may be chosen according to specific requirements: thus, for example, FIG. 10 illustrates a block 1 having an inclined surface 31 which connects the flat surface 4 to the bottom 10, so as to obtain for example a roofing tile.

Figure 9:
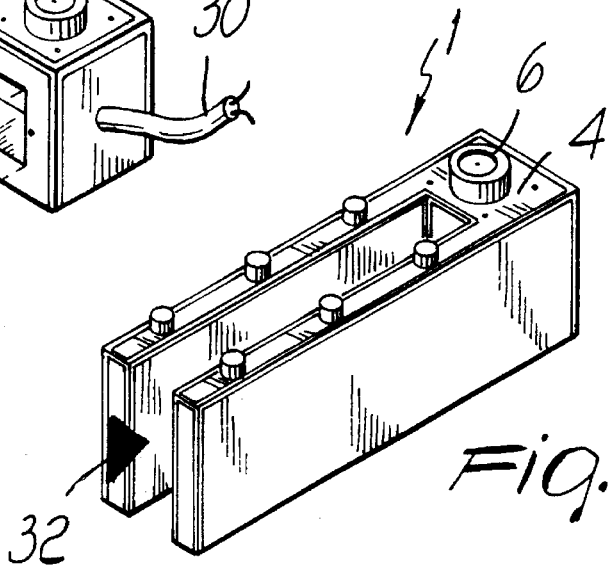
FIGS. 9, 10 and 11 illustrate some particular configurations for the block.

In another embodiment shown in FIG. 9, a fifth seat 32 is formed at the longitudinal median axis, starting from one end and for such a length as to allow at least one stud 6 to protrude beyond the flat surface 4; the block assumes a U-like shape having wings, and a plurality of smaller studs protruding from the wings.

Figure 11:
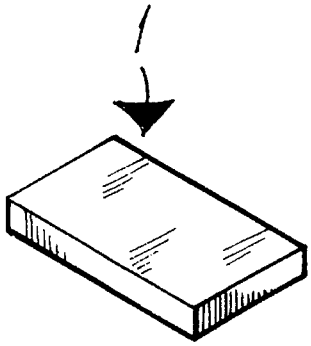

A further embodiment is illustrated in FIG. 11, wherein the block is essentially shaped like a parallelepiped and constitutes a finishing component or resembles the shape of a tile or of a marble plate.

This embodiment is provided only with means suitable to allow the coupling of cables.

The number and arrangement of the studs 6 may naturally also be the most appropriate according to the specific requirements and thus, for example, said studs can be arranged along two rows which are parallel to each other or not.

Figure 5:
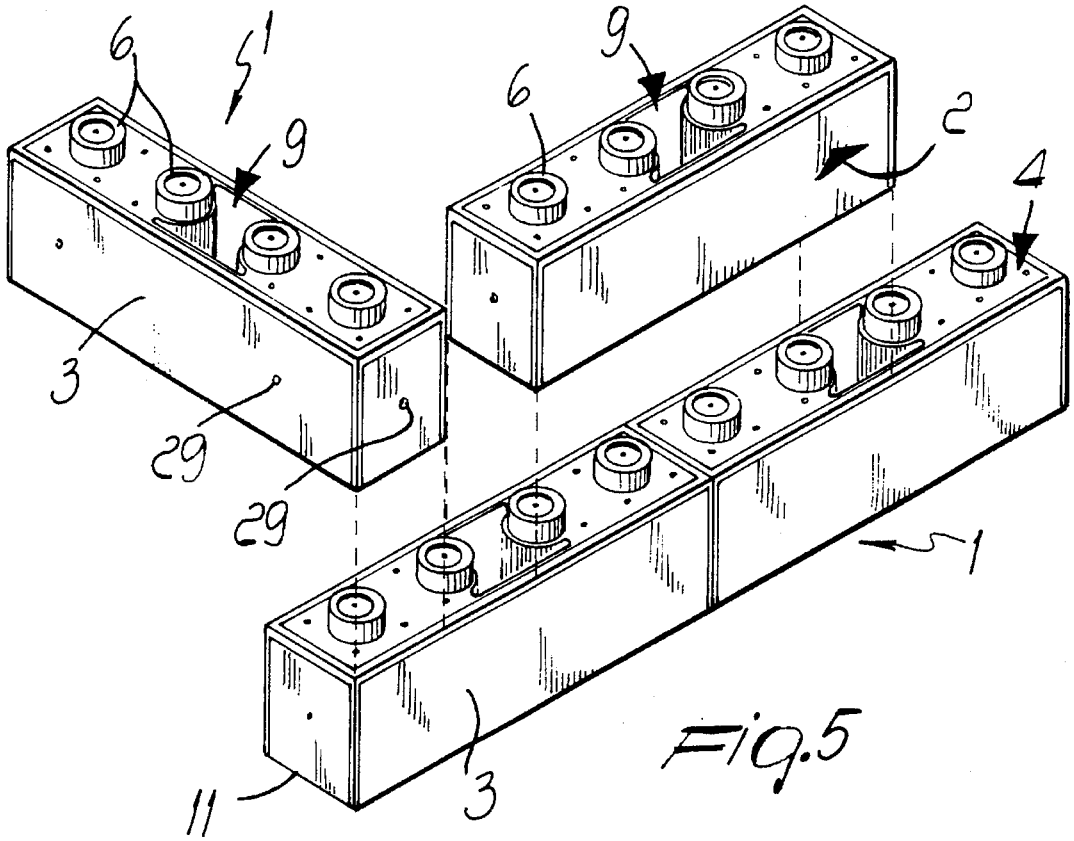
FIG. 5 shows a possible mutual arrangement of a plurality of blocks.
Figure 6:
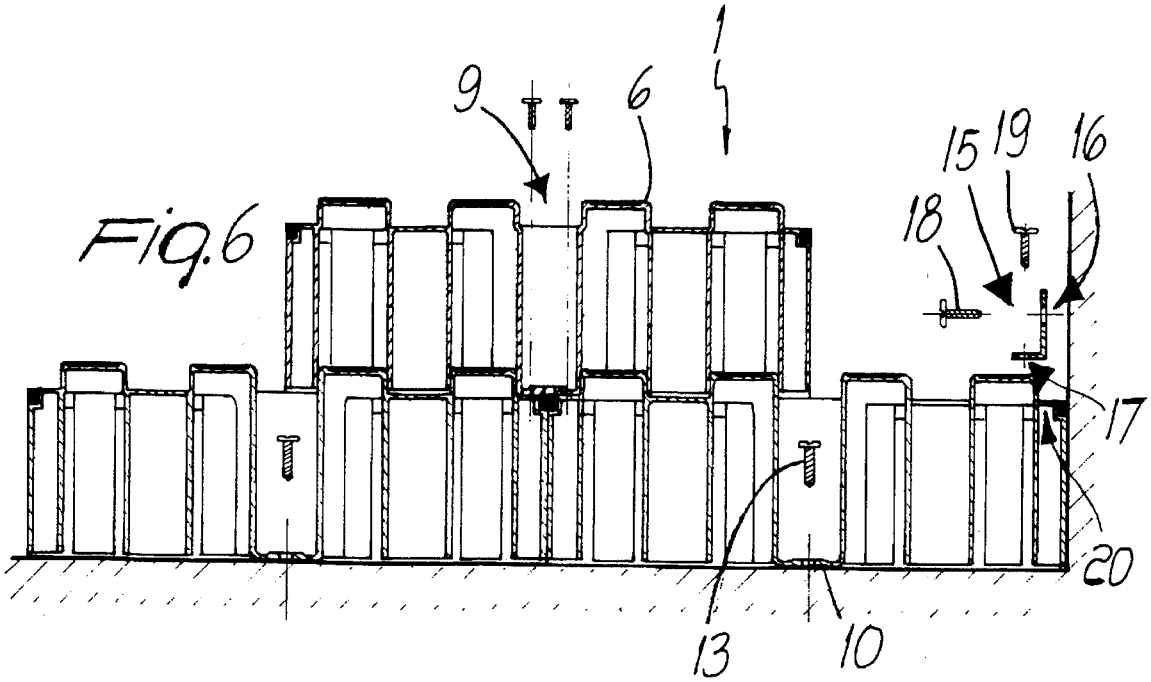
FIG. 6 is a sectional view, taken along a transverse median plane, of a plurality of mutually stacked blocks.
Figure 7:
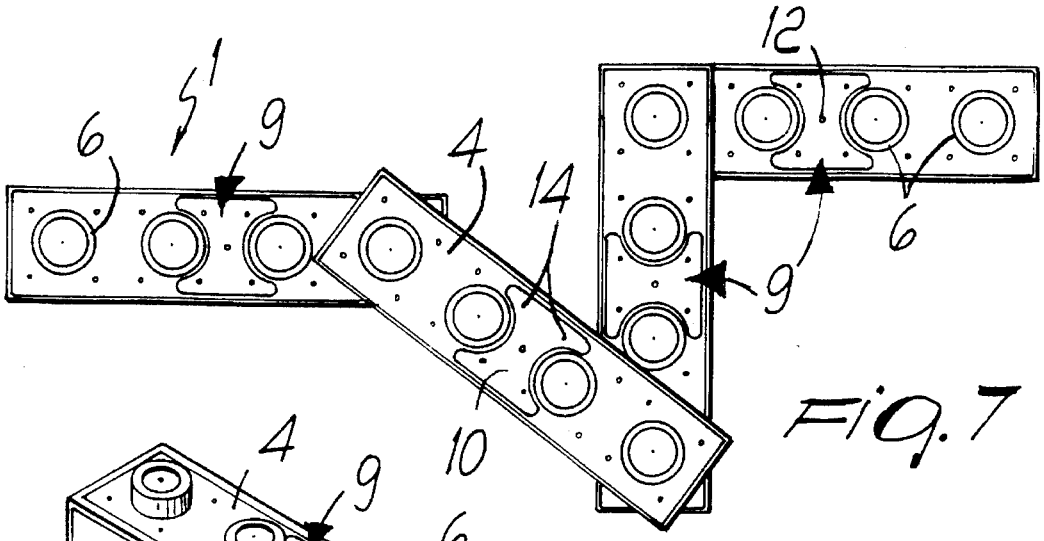
FIG. 7 shows a further arrangement for the blocks.

Use of the block according to the present invention is immediate, since it is possible, as shown for example in FIGS. 5, 6 and 7, to build partitions or shelving or table legs, simply by mutually stacking, in the most appropriate manner, a plurality of blocks. By virtue of the temporary coupling means, the bonding means and the connecting elements, the blocks are considerably compact while having an aesthetic appearance which is very similar to that of traditional bricks, with reduced costs and assembly by unskilled personnel.

The invention is naturally susceptible to numerous modifications and variations, all of which are within the scope of the same inventive concept.

The materials and the dimensions which constitute the individual elements of the block may also naturally be the most pertinent according to the specific requirements.

We claim:

1. Building block, comprising: a hollow body having modular dimensions; temporary coupling means being provided at an upper region of said body;

first engagement means being formed underneath said body at a lower region thereof for interacting with a temporary coupling means of a lower building block;

at least one hollow blind frog being opened at said upper region of said body for receiving anchoring means for securing said block in a building structure; and a bottom element for closing said at least one hollow blind frog at said lower region of said body, said bottom element connecting lower perimetric edges of said lower region.

2. Building block according to claim 1, wherein a first central hole is formed at said bottom element for accommodating said anchoring means for anchoring said body to the ground.

3. Building block according to claim 2, wherein one or more second holes are formed at said bottom element, said second holes being lateral with respect to said central hole and acting as seats for further screws or screw anchors for securing the block in a building structure and for increasing rigidity with respect to other mutually stacked or associated blocks.

4. Building block according to claim 1, wherein a flat surface is provided in the upper region of said hollow body, whereas an opening is formed in its lower region, said temporary coupling means protruding at said flat surface and being preferably constituted by at least one stud which has a plan shape of any one of a circular and a polygonal shape.

5. Building block according to claim 4, wherein said studs are arranged at said flat surface along one or more rows and at a pitch which is equal to their width.

6. Building block according to claim 4, wherein said temporary coupling means interact with engagement means formed underneath a hollow body of an upper building block, said engagement means being constituted by adapted first seats for accommodating said studs, wings protruding underneath said flat surface being further provided laterally to said first seats, said studs being snapable in said first seats, at least one of said wings being elastically deformable for allowing placement of said stud within said first seats and for locking it in this position.

7. Building block according to claim 1, further comprising a framework, and wherein said body defines lateral perimetric edges extending between said upper and lower regions thereof and upper perimetric edges at said upper region, second and third engagement means for connection to said framework being provided respectively at at least one of said lateral and upper perimetric edges, said framework being engaged by said second engagement means at said lateral perimetric edges and by said third engagement means at said upper perimetric edges .

8. Building block according to claim 7, wherein said second and third engagement means comprise adapted second and third seats preferably and respectively shaped so as to form a dovetail and a step, said dovetails and steps being provided at said lateral and upper perimetric edges.

9. Building block according to claim 8, wherein said framework comprises an upper frame and legs connected to said frame, said legs being shaped complementarily to said second seats for being inserted at said second seats, whereas the upper frame of said framework is arrangeable at said third seats.

10. Building block according to claim 9, wherein said framework has such an aesthetic configuration as to resemble the presence of the mortar gap usually present between two known bricks.

11. Building block according to claim 9, wherein said framework legs allow to mutually connect two of said hollow bodies which are mutually adjacent, thus constituting an element for strengthening said block.

12. Building block according to claim 1, wherein at least one anchoring bracket is fixable in the upper region of said hollow body.

13. Building block according to claim 12, further comprising, in combination, one or more anchoring brackets which are preferably L-shaped and on the wings of which are formed adapted third or fourth holes, first and second screws being placed at said holes, said first screws anchoring said bracket to an existing structure and said second screws being enagageable with adapted fifth holes formed on said flat surface laterally to said studs.

14. Building block according to claim 1, wherein at a lateral surface of said hollow body are appliable silk-screen prints.

15. Building block according to claim 14, further comprising, at the lateral surfaces of said hollow body, guiding notches for guiding an appropriate tool adapted to drill holes allowing passage of electric cables.

16. Building block according to claim 1, wherein said hollow body, preferably shaped as a parallelepiped with a rectangular base, is preferably made of plastic material.

17. Building block according to claim 1, wherein said hollow body has an appropriate coloring or silk-screen print at its lateral surfaces.

18. Building block according to claim 1, wherein the dimensions of said hollow bodies are such as to allow modular use preferably by using a length which is a multiple of the width.

19. Building block according to claim 1, wherein any of an adhesive product and a double-adhesive tape is associable underneath said bottom of said frog.

20. Building block, comprising:

a hollow body having modular dimensions, said body defining lateral perimetric edges extending between an upper and a lower region thereof, upper perimetric edges at said upper region and lower perimetric edges at said lower region;

temporary coupling means being provided at said upper region of said body;

first engagement means being formed underneath said body at said lower region thereof for interacting with a temporary coupling means of a lower building block;

at least one hollow blind frog being opened at said upper region of said body for receiving anchoring means for securing said block in a building structure;

a bottom element for closing said at least one hollow blind frog at said lower region of said body, said bottom element connecting lower perimetric edges of said lower region;

a framework for strengthening said block; second engagement means for connection to said framework, said second engagement means being provided at at least one of said lateral perimetric edges; and third engagement means connected to said framework, said third engagement means being provided at at least one of said upper perimetric edges of said upper region, said framework being engaged by said second engagement means at said lateral perimetric edges and by said third engagement means at said upper perimetric edges for connecting mutually adjacent hollow bodies.

* * * * *